US006840804B2

(12) United States Patent
Murakami et al.

(10) Patent No.: US 6,840,804 B2
(45) Date of Patent: Jan. 11, 2005

(54) FITTING STRUCTURE OF WATERPROOF PLUG

(75) Inventors: Takao Murakami, Shizuoka (JP); Masaru Fukuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 482 days.

(21) Appl. No.: 09/863,360

(22) Filed: May 24, 2001

(65) Prior Publication Data

US 2001/0049226 A1 Dec. 6, 2001

(30) Foreign Application Priority Data

May 31, 2000 (JP) ..... P.2000-162310

(51) Int. Cl.[7] ..... H01R 13/40
(52) U.S. Cl. ..... 439/587
(58) Field of Search ..... 439/587, 589, 439/274, 275, 279, 523

(56) References Cited

U.S. PATENT DOCUMENTS 5,035,638 A * 7/1991 Kourimsky ..... 439/275
5,364,285 A 11/1994 Sakurai ..... 439/275

FOREIGN PATENT DOCUMENTS

JP 9-106852 4/1997

* cited by examiner

*Primary Examiner*—Javaid Nasri
(74) *Attorney, Agent, or Firm*—Morgan, Lewis & Bockius LLP

(57) ABSTRACT

An electric wire includes a conductive core wire and an insulative sheath covering the core wire. An elastic waterproof plug is fit with the electric wire such that a first longitudinal end portion thereof is fit with the core wire, and a second longitudinal end portion thereof is fit with the sheath. A conductive terminal is electrically connected with the electric wire, and inserted into a terminal insertion hole formed in the waterproof connector housing together with the waterproof plug to seal the terminal insertion hole. The terminal includes a first clamping member which clamps over the first end portion of the waterproof plug, and a second clamping member which clamps over a part of the core wire exposed from the first end portion of the waterproof plug.

5 Claims, 3 Drawing Sheets

FITTING STRUCTURE OF WATERPROOF PLUG

BACKGROUND OF THE INVENTION

This invention relates to a fitting structure of a waterproof plug for sealing a gap between a terminal insertion hole in a waterproof connector and a wire extending from a terminal inserted in the terminal insertion hole.

FIG. 3 shows a related waterproof connector analogous to a connector disclosed in Japanese Patent Publication No. 9-106852A. This waterproof connector comprises a connector housing 1 formed with a plurality of terminal insertion holes 2. Terminals 3, each connected to a distal end of a wire 10, are inserted in the terminal insertion holes 2, respectively.

A rubber plug (waterproof plug) 7 is fit with an outer peripheral face of the wire 10 extending rearwardly from the terminal 3. When the terminal 3 is inserted in the terminal insertion hole 2 in the connector housing 1, the rubber plug 7 is held in intimate contact with the inner peripheral face of the terminal insertion hole 2, thereby sealing a gap between the wire 10 and the terminal insertion hole 2. In this case, the rubber plug 7 is clamped over the wire by wire clamping pieces 4 formed at a rear end of the terminal 3.

FIG. 4 shows details of the fitting structure of the rubber plug 7.

Core clamping pieces 5 for electrical connection to a core wire 12 of the wire 10 are formed at the rear end portion of the terminal 3, and also the wire clamping pieces 4 for clamping a sheath 11 of the wire 10 are formed at the rear end portion of the terminal 3. In the related construction, a leading end portion 7*a* of the rubber plug 7, fit on the outer peripheral face of the sheath 11, is clamped by the wire clamping pieces 4 simultaneously when clamping the sheath 11 of the wire 10 by the wire clamping pieces 4. Namely, the leading end portion 7*a* of the rubber plug 7 is fit on the outer peripheral face of the sheath 11 of the wire, and then the wire clamping pieces 4 are bent inwardly to embrace this portion, thereby clamping the rubber plug 7 and the sheath 11 together.

In the above fitting structure of the rubber plug 7, the leading end portion 7*a* of the rubber plug 7 is fit on the sheath 11 of the wire 10, and in this condition, the wire clamping pieces 4 are pressed or deformed to embrace this portion. Therefore, a diameter d1 of this clamped portion 8 has enlarged.

A diameter D1 of each terminal insertion hole 2, shown in FIG. 3, need to be larger than the diameter d1 of the clamped portion 8 of the rubber plug 7 since the clamped portion 8 is to be inserted into the terminal insertion hole 2 as shown in FIG. 5. Therefore, when the diameter d1 of the clamped portion 8 increases by an amount corresponding to the thickness t of the sheath 11 of the wire 10, the diameter D1 of the terminal insertion hole 2 correspondingly increases. As a result, there has been encountered a problem that the pitch P1 of the terminal insertion holes 2 increases, so that the size of the waterproof connector is enlarged.

SUMMARY OF THE INVENTION

With the above problems in view, it is an object of this invention to provide a fitting structure of a waterproof plug in which the diameter of a clamped portion of the waterproof plug can be made small as much as possible, so that the diameter of terminal insertion holes in a connector housing can be made small, and as a result the pitch of the terminal insertion holes can be reduced, so that a waterproof connector can have a small size.

In order to achieve the above object, according to the invention, there is provided a waterproofing structure for a waterproof connector housing, comprising:

an electric wire, including a conductive core wire and an insulative sheath covering the core wire;

an elastic waterproof plug, fit with the electric wire such that a first longitudinal end portion thereof is fit with the core wire, and a second longitudinal end portion thereof is fit with the sheath; and a conductive terminal, electrically connected with the electric wire, and inserted into a terminal insertion hole formed in the waterproof connector housing together with the waterproof plug which seals the terminal insertion hole, the terminal including a first clamping member which clamps over the first end portion of the waterproof plug.

In this configuration, since the clamped portion of the waterproof plug is fit directly with the outer peripheral face of the core wire of the electric wire from which the sheath has been removed, the diameter of clamped portion is smaller as compared with the related structure in which the waterproof plug is clamped over the insulating sheath.

Therefore, the diameter of the terminal insertion holes in the connector housing can be reduced, and the pitch of the terminal insertion holes can be reduced accordingly, and thereby the waterproof connector can be formed into a small size.

Preferably, the terminal includes a second clamping member which clamps over a part of the core wire exposed from the first end portion of the waterproof plug.

In this configuration, since the fixing of the waterproof plug and the fixing of the core wire are both effected by the clamping method, the both fixings can be carried out at the same time in one clamping step.

According to the invention, there is also provided A waterproofing method for a waterproof connector housing, comprising the steps of:

providing an electric wire, including a conductive core wire and an insulative sheath covering the core wire;

fitting an elastic waterproof plug with the electric wire such that a first longitudinal end portion thereof is fit with the core wire, and a second longitudinal end portion thereof is fit with the sheath;

connecting a conductive terminal with the electric wire electrically, while clamping the first end portion of the waterproof plug; and inserting the terminal into a terminal insertion hole formed in the waterproof connector housing together with the waterproof plug to seal the terminal insertion hole.

Preferably, the method further comprises the step of clamping a part of the core wire exposed from the first end portion of the waterproof plug with the terminal.

Here, it is preferable that the clamping step for the core wire is performed at the same time with the clamping step for the first end portion of the waterproof plug.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
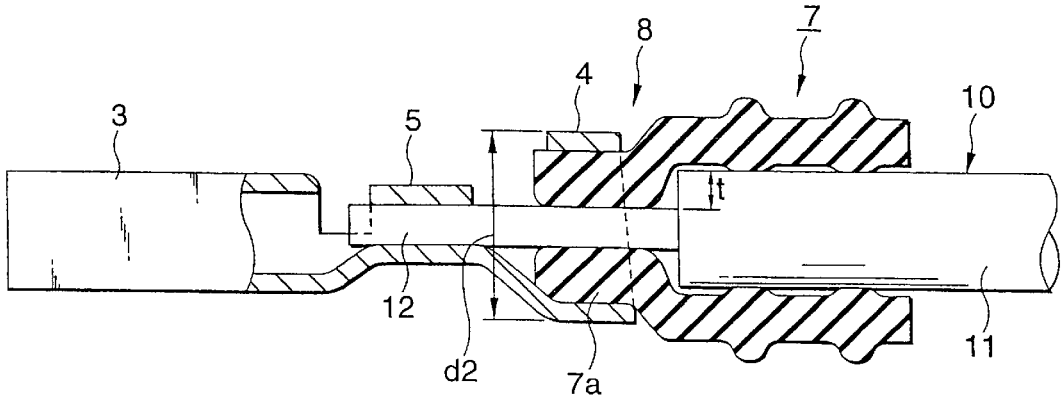
FIG. 1 is a longitudinal cross-sectional view showing a fitting structure of a rubber plug for a waterproof connector, according to one embodiment of the invention.
Figure 3:
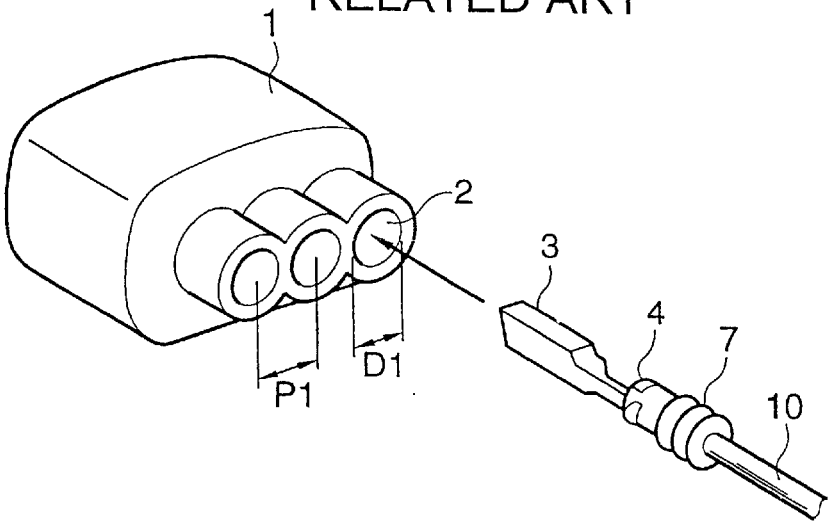
FIG. 3 RELATED ART
FIG. 3 is a perspective view showing the construction of a related art waterproof connector.
Figure 4:
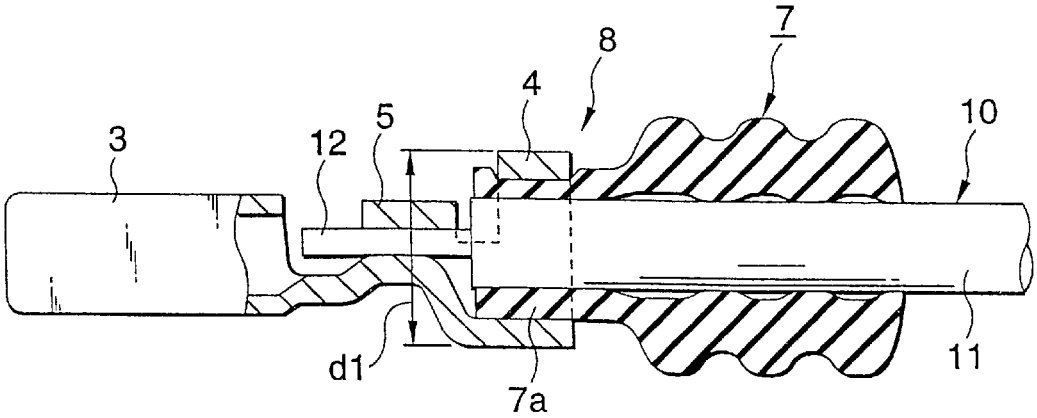
FIG. 4 RELATED ART
FIG. 4 is a longitudinal cross-sectional view showing a related fitting structure of a rubber plug for the related art waterproof connector.
Figure 5:
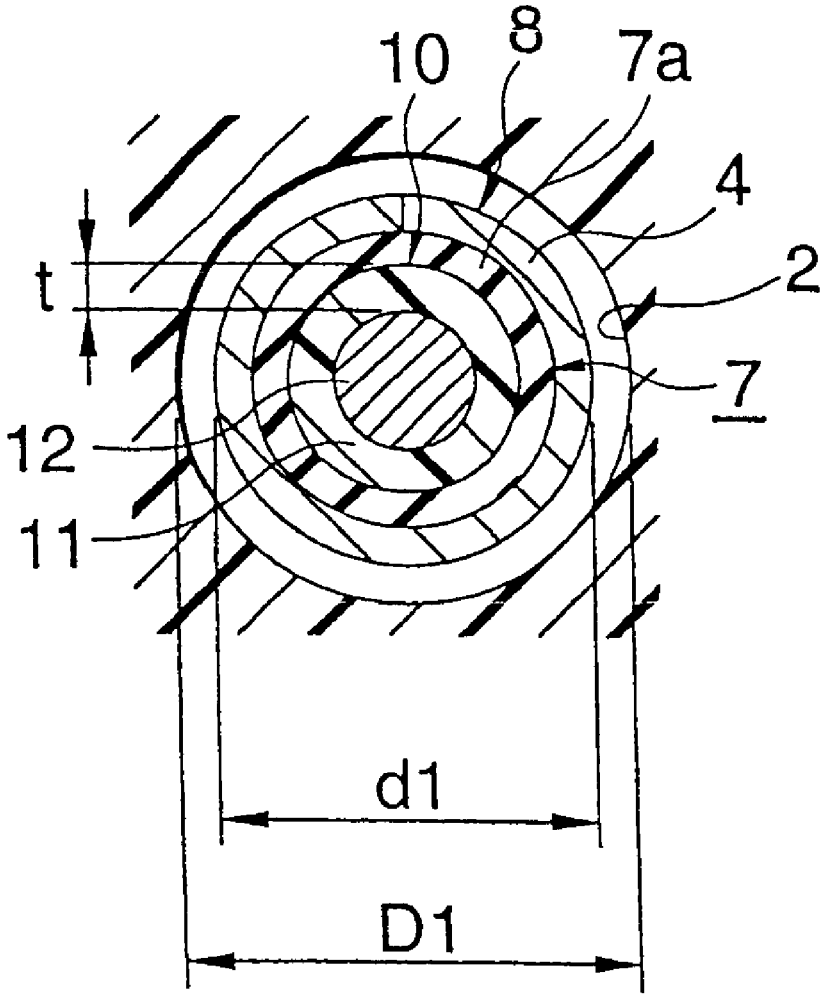
FIG. 5 RELATED ART
FIG. 5 is a cross-sectional view showing the relation between the fitting structure and a terminal insertion hole in a related art connector housing.

A preferred embodiment of the invention will now be described with reference to FIGS. 1 and 2. Same reference numerals are assigned to members similar to those in the related structure shown in FIGS. 3 to 5, and detailed explanation for those are omitted here.

Core clamping pieces 5 and wire clamping pieces 4 are formed at a rear end portion of a terminal 3. In this embodiment, that portion of a sheath 11 of a wire 10, extending from a distal end thereof to a position adjacent to the wire clamping pieces 4, is removed to expose a core wire 12. Then, a leading end portion 7*a* of the rubber plug (waterproof plug) 7 is fit directly on an outer peripheral face of the exposed core wire 12. In this condition, the wire clamping pieces 4 are bent inwardly to embrace the leading end portion 7*a*, so that the rubber plug 7 is clamped and fixed to the outer peripheral face of the core wire 12. The distal end portion of the core wire 12 is clamped and fixed to the terminal by the core clamping pieces 5 disposed forwardly of the wire clamping pieces 4.

Thus, the leading end portion 7*a* of the rubber plug 7 is directly clamped and secured to the outer peripheral face of the core wire 12, and therefore the diameter d2 of a clamped portion 8 of the rubber plug 7 is smaller by an amount substantially double the thickness t of the sheath 11 as compared with the related structure in which the rubber plug 7 is clamped onto the sheath 11.

Figure 2:
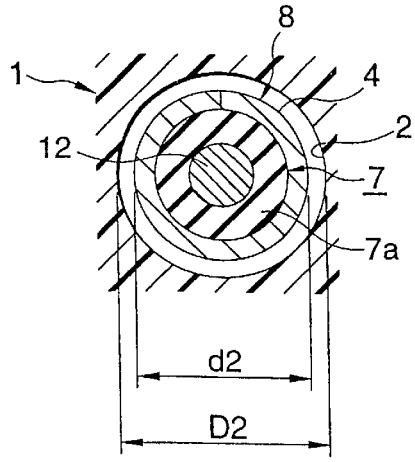
FIG. 2 is a cross-sectional view showing the relation between the fitting structure and a terminal insertion hole in a connector housing.

Thus, the diameter d2 of the clamped portion 8 is reduced, and therefore a diameter D2 of each terminal insertion hole 2 in a connector housing can be reduced as shown in FIG. 2. As a result of reduction of the diameter of the terminal insertion holes 2, the pitch of the terminal insertion holes 2 can be reduced, and therefore the waterproof connector can be formed into a small size.

In the case of this terminal 3, the fixing of the rubber plug 7 and the fixing of the core wire 12 to the terminal 3 are both effected by the clamping method, and therefore there is achieved another advantage that the fixing of the rubber plug 7 and the fixing of the core wire 12 can be carried out at the same time in one clamping step.

In the above embodiment, although the rubber plug is used as the waterproof plug, the waterproof plug may be made of any other suitable resin material in so far as the material is an elastic material.

The method of fixing the core wire 12 to the terminal 3 is not limited to the above clamping method, but may be, for example, a press-connecting method.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A waterproofing structure for a waterproof connector housing, comprising:

an electric wire, including a conductive core wire having al external diameter and an insulative sheath having an external diameter and covering the core wire;

an elastic waterproof plug including a first longitudinal end portion formed with a first internal diameter corresponding to the external diameter of the core wire, and including a second longitudinal end portion formed with a second internal diameter corresponding to the external diameter of the sheath; and a conductive terminal, electrically connected with the electric wire, and inserted into a terminal insertion hole formed in the waterproof connector housing together with the waterproof plug which seals the terminal insertion hole, the terminal including a first clamping member which clamps over the first end portion of the waterproof plug.

2. A waterproofing structure for a waterproof connector housing, comprising:

an electric wire, including a conductive core wire having an external diameter and an insulative sheath having an external diameter and covering the core wire;

an elastic waterproof plug, fitted with the electric wire such that a first longitudinal end portion thereof is fitted directly with the external diameter of the core wire, and a second longitudinal end portion thereof is fitted directly with the external diameter of the sheath; and a conductive terminal, electrically connected with the electric wire, and inserted into a terminal insertion hole formed in the waterproof connector housing together with the waterproof plug which seals the terminal insertion hole, the terminal including a first clamping member which clamps over the first end portion of the waterproof plug and a second clamping member which clamps over a part of the core wire exposed from the first end portion of the waterproof plug.

3. A waterproofing method for a waterproof connector housing, comprising the steps of:

providing an electric wire, including an exposed first portion of a conductive core wire having an external diameter and an insulative sheath having an external diameter and covering a second portion of the core wire;

fitting an elastic waterproof plug with the provided electric wire such that a first longitudinal end portion thereof is fitted with the exposed first portion of the external diameter of the core wire, and a second longitudinal end portion thereof is fitted with the external diameter of the sheath;

connecting a conductive terminal with the electric wire electrically, while clamping the first end portion of the waterproof plug; and inserting the terminal into a terminal insertion hole formed in the waterproof connector housing together with the waterproof plug to seal the terminal insertion hole.

4. A waterproofing method for a waterproof connector housing, comprising the steps of:

providing an electric wire, including a conductive core wire having an external diameter and an insulative sheath having an external diameter and covering the core wire;

fitting an elastic waterproof plug with the electric wire such that a first longitudinal end portion thereof is fitted with the external diameter of the core wire, and a second longitudinal end portion thereof is fitted with the external diameter of the sheath;

connecting a conductive terminal with the electric wire electrically, while clamping the first end portion of the waterproof plug;

inserting the terminal into a terminal insertion hole formed in the waterproof connector housing together with the waterproof plug to seal the terminal insertion hole; and clamping a part of the core wire exposed from the first end portion of the waterproof plug with the terminal.

5. The waterproofing method as set forth in claim 4, wherein the clamping step for the core wire is performed at the same time with the clamping step for the first end portion of the waterproof plug.

* * * * *